United States Patent [19]

Kristof et al.

[11] 4,321,445

[45] Mar. 23, 1982

[54] DOOR LATCH INTERLOCK SYSTEM FOR MICROWAVE OVEN

[75] Inventors: Mark J. Kristof; John R. Schwaderer, both of Marion, Ohio

[73] Assignee: Whirlpool Corporation, Benton Harbor, Mich.

[21] Appl. No.: 117,796

[22] Filed: Jan. 28, 1980

[51] Int. Cl.[3] ..... H05B 6/68

[52] U.S. Cl. ..... 219/10.55 C; 219/10.55 D; 200/50 C; 200/61.76; 126/197

[58] Field of Search ..... 219/10.55 C, 10.55 D, 219/10.55 B; 126/197; 200/50 A, 50 C, 50 R, 61.62, 61.71, 61.72, 61.73, 61.74, 61.75, 61.76, 61.77, 61.78, 61.79, 61.8, 61.81, 61.82

[56] References Cited

U.S. PATENT DOCUMENTS

| | | | |
|---|---|---|---|
| 3,659,068 | 4/1972 | Duffner et al. | 219/10.55 C |
| 3,715,552 | 2/1973 | Umezu et al. | 219/10.55 C |
| 3,715,554 | 2/1973 | Umezu et al. | 219/10.55 C |
| 3,728,512 | 4/1973 | Shirakami | 219/10.55 C |
| 3,748,423 | 7/1973 | Haagensen | 219/10.55 C |
| 3,777,084 | 12/1973 | Rys | 200/50 A |
| 3,777,098 | 12/1973 | Tapper | 219/10.55 C |
| 3,865,097 | 2/1975 | Robinson | 219/10.55 C X |
| 3,968,983 | 7/1976 | Heit et al. | 126/197 X |
| 4,006,121 | 2/1977 | Isono | 219/10.55 C X |
| 4,025,804 | 5/1977 | Rickard | 219/10.55 B X |
| 4,101,750 | 7/1978 | Doner | 219/10.55 C |

*Primary Examiner*—Gene Z. Rubinson
*Assistant Examiner*—Philip H. Leung
*Attorney, Agent, or Firm*—Wegner, Stellman, McCord, Wood & Dalton

[57] ABSTRACT

A door latch interlock system for use in a microwave oven in selectively securing a closure door in a closed position across the opening to the microwave oven cavity. The structure for selectively securing the door in the closed position includes a guide on the cabinet, a slider member movably carried by the guide, catch structure carried by the slider member, latch structure carried by the closure and engageable with the catch structure as an incident of the closure being disposed in the latching position, an actuator carried by the closure for operating one of the switches of the electrical circuit for controlling delivery of electric power to the microwave energy generator of the oven to permit operation of the generator only when the door is latched in the closed position, and manually operable structure carried by the closure for arranging the actuator to cause the one switch to prevent operation of the generator and concurrently move the slider member to the released disposition. A second switch control is carried by the latch structure for causing a second of the electrical circuit switches to prevent operation of the microwave energy generator whenever the closure door is in the closed position. In the illustrated embodiment, the guide is defined by a vertical support bar. The latch structure, in the illustrated embodiment, is defined by a pair of interconnected arms pivoted from the support bar. In the illustrated embodiment, the slider member is biased upwardly to the latching position. In the illustrated embodiment, the manually operable structure includes a pushbutton connected to the door handle.

18 Claims, 6 Drawing Figures

DOOR LATCH INTERLOCK SYSTEM FOR MICROWAVE OVEN

BACKGROUND OF THE INVENTION

1. Field of the Invention

This invention relates to microwave ovens and in particular to means for controlling the latch means of the oven door.

2. Description of the Prior Art

In U.S. Pat. No. 4,101,750 of John T. Doner, which patent is owned by the assignee hereof, an improved door interlock system for use in a microwave oven is shown and claimed. As discussed in that patent, in the conventional microwave oven, a microwave energy generating device is provided for delivering microwave energy into a cavity defined by a cabinet having a front opening selectively closed by a door. To prevent leakage of the microwave energy from the cavity during operation of the oven, it is important to positively prevent access to the oven cavity when the microwave energy generating means is energized so as to prevent injury to the user. Thus, it is conventional to provide interlocking means for assuring that the cabinet door is in the closed and latched position before the microwave energy generating means may be energized. The present invention is concerned with a further improved form of such interlocking system providing improved convenience to the user of the microwave oven in permitting the door to be closed and latched simply by swinging it to the closed position.

The background art discussed in Doner U.S. Pat. No. 4,101,750 is similarly of interest in connection with the present interlock system. More specifically, as discussed therein, one form of such an interlocking system in an electronic oven is shown in U.S. Pat. No. 3,339,054 of Homer W. Deaton, wherein the control includes timer operated switches, a holding circuit including a momentary switch, a safety interlock switch, a safety switch, a door switch, and a thermostat switch.

Shiro Umezu et al disclose, in U.S. Pat. No. 3,699,299, a locking member for locking the door in the closed position. A switch is disposed in the cabinet for controlling operation of the microwave energy generator, and means interlocked with the handle are provided for operating the switch to de-energize the generator when the locking device releases the door.

Shiro Umezu et al, in U.S. Pat. No. 3,715,552, show a microwave oven wherein the door locking mechanism comprises an operating member mounted on the door outside the heating chamber, a switch in the cabinet, and means interlocked with the locking mechanism for operating the switch for de-energizing the generator when the operating member is operated to unlock the locking mechanism.

In U.S. Pat. No. 3,777,098 of William R. Tapper, a door latch assembly for use in a microwave oven is disclosed as having a latch element carried by the oven door and a latch receiving element mounted on the oven cabinet. The latch receiving element includes a first, fixed aperture for receiving an aligning projection of the latch element, and a movable body having a pair of apertures receiving hooked latch portions of the latch element. The movable body includes a pair of ported plates having bearing surfaces adapted to be moved by the latches. The latches extend into the plate ports after a preselected movement thereof and are secured therein by a pair of leaf springs which move the plates and body upwardly in a secured position. A safety switch is connected to each port plate and is controlled by the hooked portions of the latches.

In U.S. Pat. No. 3,816,688 of Rex E. Fritts, a safety interlock system for microwave ovens is shown having means for interrupting the power supply and/or actuating a failure indicating device. The sensing means is arranged so as to not carry the load current until a malfunction of a companion interlock occurs.

Takeshi Takayama et al, in U.S. Pat. No. 3,823,294, show a door interlocking system having a solenoid operated contactor with the solenoid thereof switched by at least two switching means, one of which is manually operable and the other of which is operated by operation of the lock means acting upon the door which, in turn, is operated by a drive coil connected with the power supply through one of the switching means.

In U.S. Pat. No. 3,865,097 Donald B. Robinson discloses a latch for microwave ovens provided with a plate mounted on the oven door with means on the oven cabinet for receiving the latch. A switch holder assembly and a slide bar are mounted on the cabinet with the switch holder assembly being stationary and the slide bar being actuated by an actuating bar, or button, accessible on the front face of the oven. A latch receiving element is pivotally supported between the switch holder assembly and the actuating slide bar for engagement by the latches so that when the oven door is closed and the slide bar is actuated against its normal upward biasing, the latch receiving element pivotally disengages from the latch and the door is permitted to open.

Rex. E. Fritts discloses, in his U.S. Pat. No. Re. 28,822, a safety interlock system for a mirowave oven incorporating sensor means for detecting any malfunction. The sensing means are associated with interlocks and the sensing means, as in Fritts' U.S. Pat. No. 3,816,688, do not carry the normal load current until a malfunction of the companion interlock occurs.

SUMMARY OF THE INVENTION

The present invention, as indicated above, provides a further improved door interlock system of the type shown and claimed in Doner U.S. Pat. No. 4,101,750, wherein the interlock system is arranged to permit the door to be closed and latched as an incident of the door being moved to the closed position. Thus, the door interlock system is adapted for use in a microwave oven having a cabinet defining an oven cavity provided with an opening, a closure movably mounted to the cabinet for movement between a closed position closing the opening and an open position providing access to the opening, electrically operable microwave energy generating means for supplying microwave energy to the cavity, and an electrical circuit including switch means for controlling delivery of electric power from an external source to the generating means.

The improved means for selectively securing the closure in the closed position, wherein the closure sealingly closes the opening, includes a slider member movably mounted to the cabinet for movement between released and latching positions, catch means movable with the slider member, latch means carried by the closure and engageable with the catch means as an incident of the closure being disposed in the closed position and the slider member being disposed in the latching position, actuator means for operating the switch means to permit operation of the generating means only when the closure is latched in the closed position, and manually operable means for arranging the actuator means to cause the switch means to prevent operation of the generating means and concurrently move the slider member to the released position for unlatching the closure in the closed position and thereby permitting the unlatched closure to be moved selectively from and to the closed position.

The switch means in the illustrated embodiment includes first and second switches for controlling provision of electrical power to the generating means and the latch means includes means for causing the second switch to close for permitting operation of the generating means only when the closure is in the closed position.

In the illustrated embodiment, the manually operable means includes a pushbutton mechanism carried by the closure.

In the illustrated embodiment, the pushbutton mechanism has means for biasing the same to arrange the actuator means suitably to cause the switch means to permit energization of the generating means when the closure is latched in the closed position.

In the illustrated embodiment, the slider member is movably carried by a guide on the cabinet. The catch means, in the illustrated embodiment, is carried by the slider member and the actuator means is carried by the closure. Further in the illustrated embodiment, the manually operable means is carried by the closure.

Further in the illustrated embodiment, means are carried by the latch means for conditioning the second of the control circuit switches to permit operation of the generating means whenever the closure is in the closed position.

In the illustrated embodiment, the catch means comprises a pin fixedly carried by the slider member. The actuator means comprises a first portion engageable with the slider member to selectively disengage the catch means from the latch means in the closed position of the closure, and a second portion defining an actuator for actuating the first switch.

Further in the illustrated embodiment, the latch means defines a cam means for urging the catch means to move the slider member toward the released position.

In the illustrated embodiment, the actuator means and manually operable means comprise a first pivot member pivotally carried by the closure and releasably engaging the slider member, a second pivot member pivotally carried by the closure releasably engaging the one switch, and manipulatable means carried by the closure for pivoting the pivot members.

In the illustrated embodiment, the actuator means and manually operable means may further include means for pivoting the second pivot member as a result of pivoting of the first pivot member.

Furthermore specifically, the latch means may include a vertical support extending along an edge of the closure, the support having horizontal extending arms fixed thereon, each of the arms having vertically downwardly extending fingers at a distal end, a pair of interconnected arms pivoted from the support in vertically spaced relationship to each other, the pivoted arms extending horizontally from the support, a lower of the pivoted arms having a downwardly extending finger thereon, a vertically disposed guide channel within the cabinet having an upwardly biased slide channel positioned for vertical reciprocating movement therein, the guide channel and the slide channel having aligned apertures for receiving the arms when the closure is in the closed position, the slide channel having horizontal pins mating in locking relationship with the fingers on the integral fixed arms when the closure is in a sealing relationship, the guide channel having a secondary switch and a monitor switch mounted thereon and engaged by the integral arms and operated to an "on" position of the generating means when the closure is moved to the sealing relationship, a guide roller on the slide channel operable when the pins move to lock the fixed arms to bear against and pivot an upper of the pivoted arms, the pivot movement operating through the interconnection to rotate the lower pivoted arm to bring the finger on the lower pivoted arm into moving contact with a primary interlock switch, the moving contact closing the switch, and pushbutton means connected to the closure handle for freeing the pins from the fixed arm fingers and for removing the lower pivoted arm contact from the primary interlock switch, the button means being inwardly movable to bear against a vertical portion of the upper pivoted arm to pivot the upper pivoted arm against the guide roller to move the slide channel downwardly releasing the pins from the fixed arm fingers, whereby an outward force applied to the closure handle after pushing the button means will allow movement of the door out from the closed position and concurrently cause operating the monitor and secondary switches to be in an "off" condition to deenergize the generating means. In the illustrated embodiment, the vertical support comprises a bar carried by the closure and the closure comprises a door pivotally mounted to the cabinet for horizontal swinging movement.

In the illustrated embodiment, the fixed arms are formed integrally with the support and the pivoted arms are interconnected by cooperating pin and link means.

In the illustrated embodiment, toggle means are provided for selectively retaining the pivotal arms in oppositely thrown dispositions.

In the illustrated embodiment, biasing means are provided for biasing the pushbutton means to an outward disposition.

Thus, the present invention comprehends a novel improvement over the structure of the assignees prior interlock system as disclosed in Doner U.S. Pat. No. 4,101,750 providing a highly desirable improved functioning in a novel and simple manner. The improved structure is extremely simple and economical of construction while yet providing the above discussed advantages.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
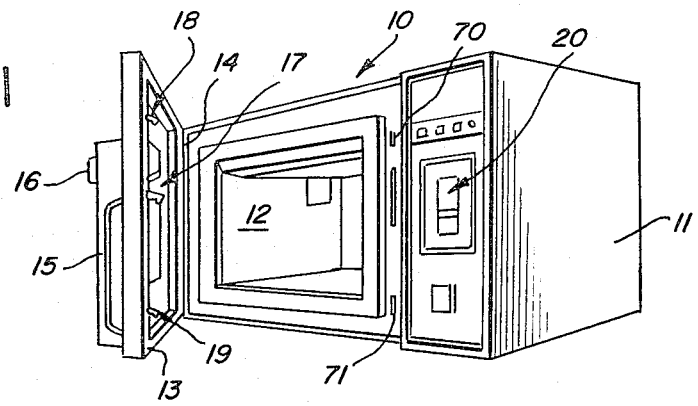
FIG. 1 is a perspective view of a microwave oven having closure interlock means embodying the invention.

In the illustrative embodiment of the invention as disclosed in the drawing, a microwave oven generally designated 10 is shown to include a cabinet 11 defining an oven cavity 12 selectively closed by a closure door 13 mounted to the cabinet by a suitable hinge 14 for swinging movement horizontally between an open position, as shown in FIG. 1, and a closed position wherein the door extends across the front opening of the oven cavity 12. As further shown in FIG. 1, the closure door is provided with a handle 15 and a pushbutton control 16 for controlling the disposition of an actuator means generally designated 17. The closure further includes a pair of fixed latches 18 and 19.

Figure 2:
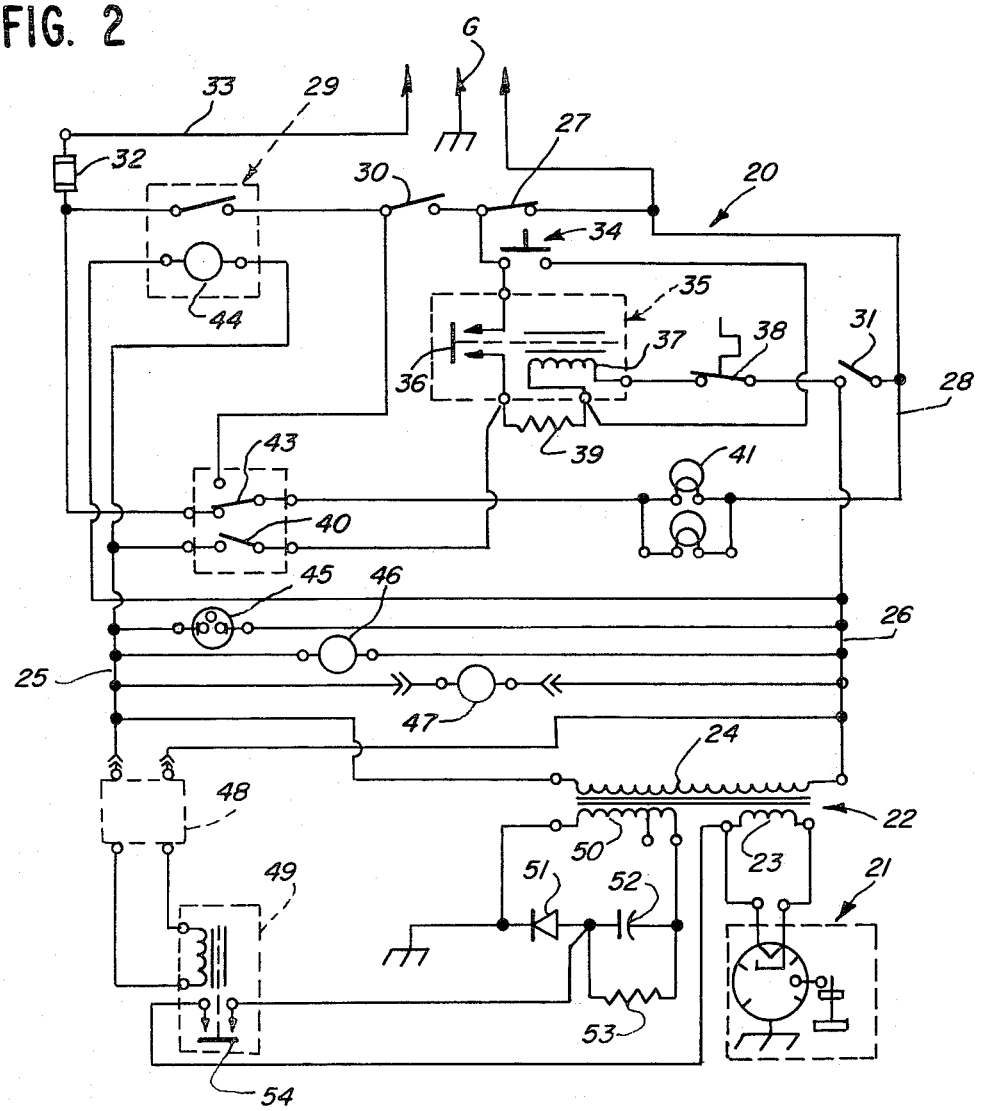
FIG. 2 is a schematic wiring diagram of the electrical circuit thereof.

As further shown in FIG. 1, the oven includes an operating control 20 for controlling the energization of a magnetron generally designated 21 (FIG. 2) comprising the microwave energy generating means of the oven. As illustrated in FIG. 2, magnetron 21 is energized from a power transformer generally designated 22 which includes a first secondary filament winding 23 and a primary winding 24. Primary winding 24 is connected between a first power lead 25 and a second power lead 26. Lead 26 is connected through a normally open secondary door interlock switch 31 to a power supply lead 28. The control circuit 20 further includes a timer switch 29 connected in series with a normally open primary door interlock switch 30 and a normally closed monitor switch 27 from power supply lead 28 through a suitable fuse 32 to the opposite power supply lead 33. Power supply leads 28 and 33 form, with ground lead G, a conventional three-wire power supply such as a conventional 110-volt, 60-cycle domestic power supply.

Control circuit 20 further includes a momentary contact start switch 34 and a cook relay generally designated 35 having a switch contact 36 connected to lead 25 through switches 30 and 29 for providing power thereto upon release of the start switch 34. A coil 37 of cook relay 35 is connected by a lead to switch 34 and through a thermal protector switch 38 to secondary door interlock switch 31. The start switch 34 is connected to the lead 25 through a resistor 39 and a door activated, normally open glass integrity switch 40.

A parallel combination of an oven light 41 and a dial light 42 is connected from power supply lead 28 through a single pole, double throw oven switch 43 and the fuse 32 to power supply lead 33.

Timer switch 29 is controlled by a suitable timer motor 44. Control 20 further includes a cook indicator 45, a fan 46, and a stirrer motor 47 connected in parallel between the power leads 25 and 26. The control further includes a solid state power selector 48 and a reed relay 49.

Power transformer 22 further includes a second secondary winding 50. Connected across winding 50 is a high voltage rectifier 51 and a high voltage capacitor 52 which may have connected in parallel therewith a high holding value resistor 53. The connection between rectifier 51 and capacitor 52 may be connected through the normally open switch 54 of the reed relay 49 to one side of the secondary filament winding 23 of transformer 22.

Figure 3:
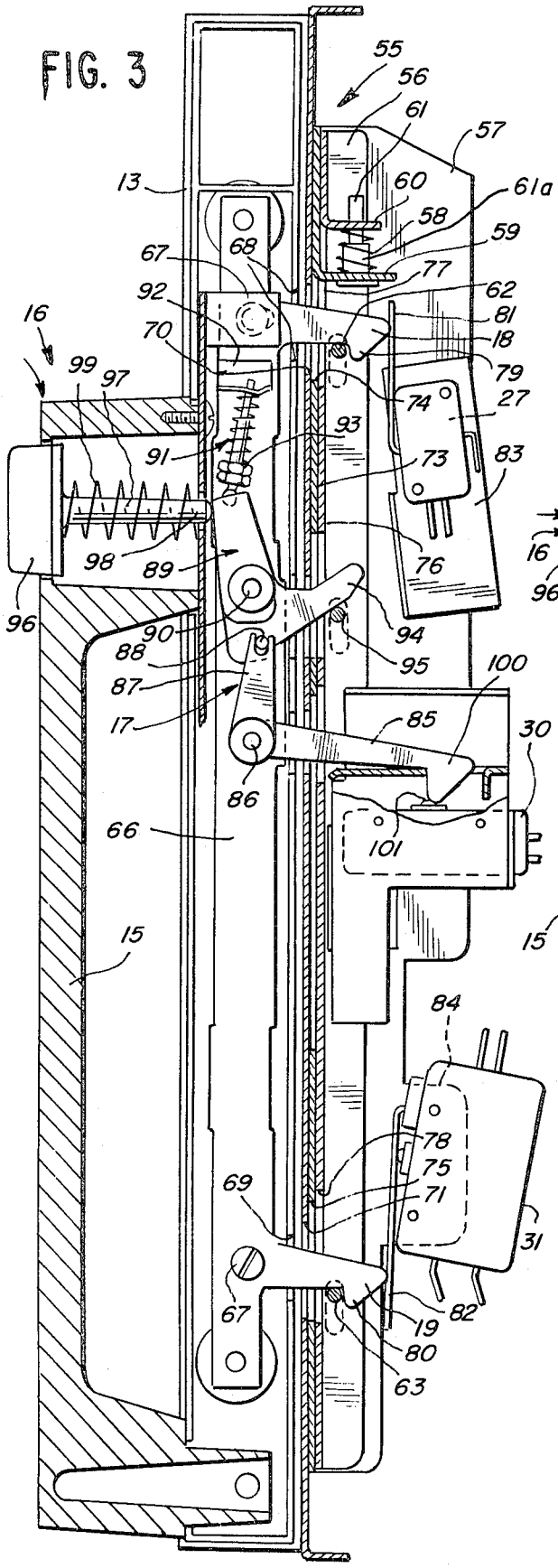
FIG. 3 is a fragmentary enlarged vertical section illustrating the arrangement of the closure interlock means with the closure in the closed position.

Referring now to FIG. 3, the door interlock means generally designated 55 includes a slider member 56 vertically slidable in a guide channel 57 carried by the cabinet 11. Slider member 56 is biased upwardly by a spring 58 acting between a turned flange 59 on guide 57 and a turned flange 60 on the slider member, the spring being coaxially mounted about a dampener member **61*a* and a spring guide 61 mounted to flange 59 and extending slidably through flange 60**.

Slider member 56 carried an upper catch 62 and a lower catch 63 adapted to be selectively engaged by an upper fixed latch 18 and a lower fixed latch 19 formed integrally in support bar 66 secured to the door 13 by screws 67. Latch 18 extends outwardly from the door through a slot 68 and latch 19 extends outwardly through a slot 69.

As shown in FIG. 1, cabinet 11 is provided with an upper slot 70 and a lower slot 71 through which the latches 18 and 19 respectively pass when the door is in the closed position illustrated in FIG. 3. Guide channel 57 includes a front flange 73 provided with an upper slot 74 and a lower slot 75. Slider member 56 is provided with a front flange 76 having an upper slot 77 and a lower slot 78. Thus, when the door 13 is in the closed position of FIG. 3, upper fixed latch 18 extends through the aligned slots 68, 70, 74 and 77 and lower latch 19 extends through aligned slots 69, 71, 75 and 78.

As further shown in FIG. 3, the inner end of the latch 18 defines a finger portion 79 interlocking with catch 62. The distal end of the latch 19 defines a finger portion 80 which interlocks with the catch 63. Thus, in the closed and latched position of FIG. 3, the latches 18 and 19 retain the door in the closed position by their engagement with the catches 62 and 63.

As further shown in FIG. 3, in the latched disposition, the distal end of the latch 18 bears against the actuator 81 of secondary door monitor switch 27 to close the switch. Further, at this time, the distal end of latch 19 engages the actuator 82 of interlock switch 31 to open the monitor switch. This disposition of the switches conditions the control circuit to an "on" position of the generating means. As shown in FIG. 3, switch 27 is carried on a bracket 83 mounted to the guide channel 57 and switch 31 is mounted to a portion 84 of the channel 57 so as to be retained in fixed disposition in the cabinet.

The primary door interlock switch 30 is actuated by an arm 85 of the actuator means 17. Arm 85 is pivotally mounted on a pivot 86 and is provided with a crank arm 87 connected by means of a pin 88 to a second arm 89 of the actuator mechanism. Arm 89, in turn, is pivotally mounted to the support bar 66 by a pivot 90.

A toggle generally designated 91 is connected between a support 92 on the support bar 66 and the distal end 93 of the crank arm 89. Toggle 91 comprises an adjustable spring toggle which selectively retains the arm 89 in the released disposition of FIG. 3 or in the thrown disposition of FIG. 5.

Figure 4:
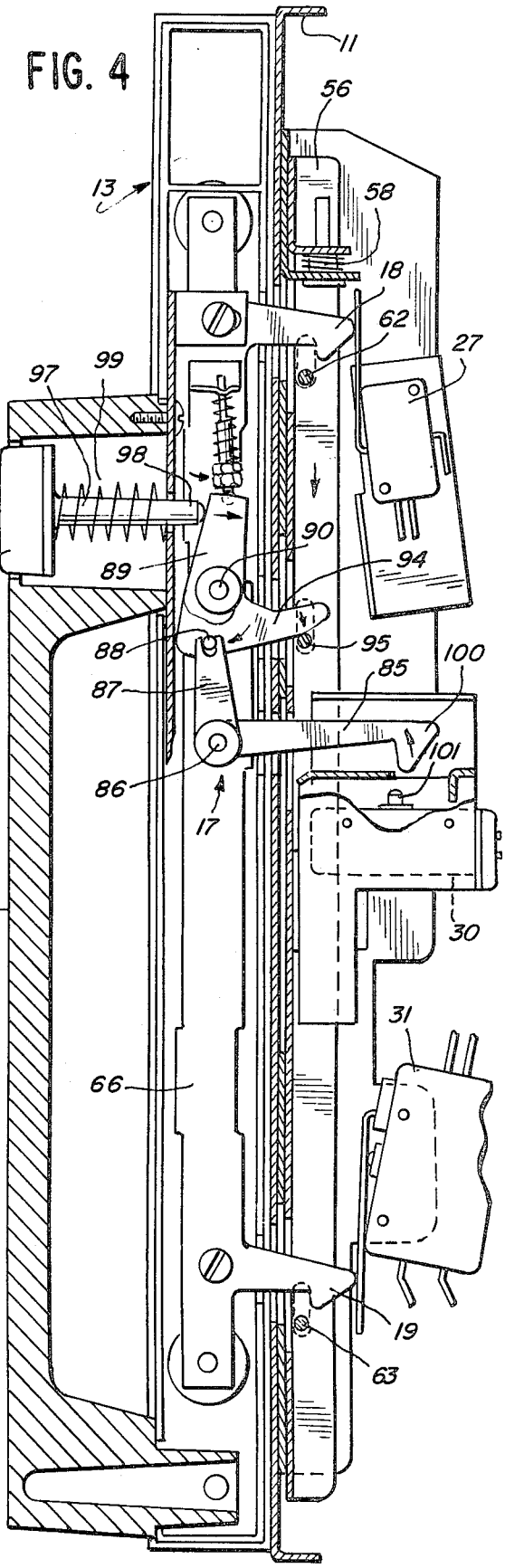
FIG. 4 is a view similar to that of FIG. 3 but with the elements of the interlock means arranged as upon actuation of the pushbutton control to effect unlatching of the closure in the closed position.

As shown in FIG. 3, pin 88 is carried on a portion of arm 89 so as to pivot the crank arm 87 as a result of pivoting of arm 89 on pivot 90. Arm 89 effectively defines a crank arm for pivoting an actuating arm 94 formed integrally therewith and arranged to engage a follower 95 carried on the slider member 56. Thus, when the crank arm 89 is swung in a clockwise direction from the release position of FIG. 3 to the actuating position of FIG. 4, arm 94 bears downwardly against the follower 95 to urge slider member 56 downwardly against the action of biasing spring 58, thereby moving the catches 62 and 63 downwardly from engagement with the latch arms 18 and 19 to unlatch the closure door. As illustrated in FIGS. 3 and 4, such clockwise motion of the crank arm 89 and actuator arm 94 is effected by suitable depression of a pushbutton 96 of the pushbutton means 16 having a stem 97 provided with an end 98 bearing against the crank arm 89. Pushbutton 96 is biased outwardly by a spring 99 coaxially of stem 97.

As illustrated in FIG. 3, arm 85 defines a distal end 100 which bears against the actuator 101 of primary door interlock switch 30 when the closure door is in the closed and latched position to close the switch 30 at that time. As illustrated in FIG. 4, when mechanism 16 is manipulated to pivot actuator means 17, arm end 100 is pivoted in a counterclockwise direction to become disengaged from actuator 101, thereby allowing the primary interlock switch to open, as illustrated in the wiring diagram of FIG. 2. Thus, the control is arranged to de-energize the microwave energy generating means 21 whenever the latch means is arranged in an unlatched condition notwithstanding the maintenance of the closure door in the closed position of FIGS. 3 and 4. As illustrated in FIG. 4, the secondary door interlock switch 31 is maintained actuated by latch 19 and the monitor switch 27 is maintained open by the latch 18 as long as the closure door 13 remains in the closed position.

Figure 5:
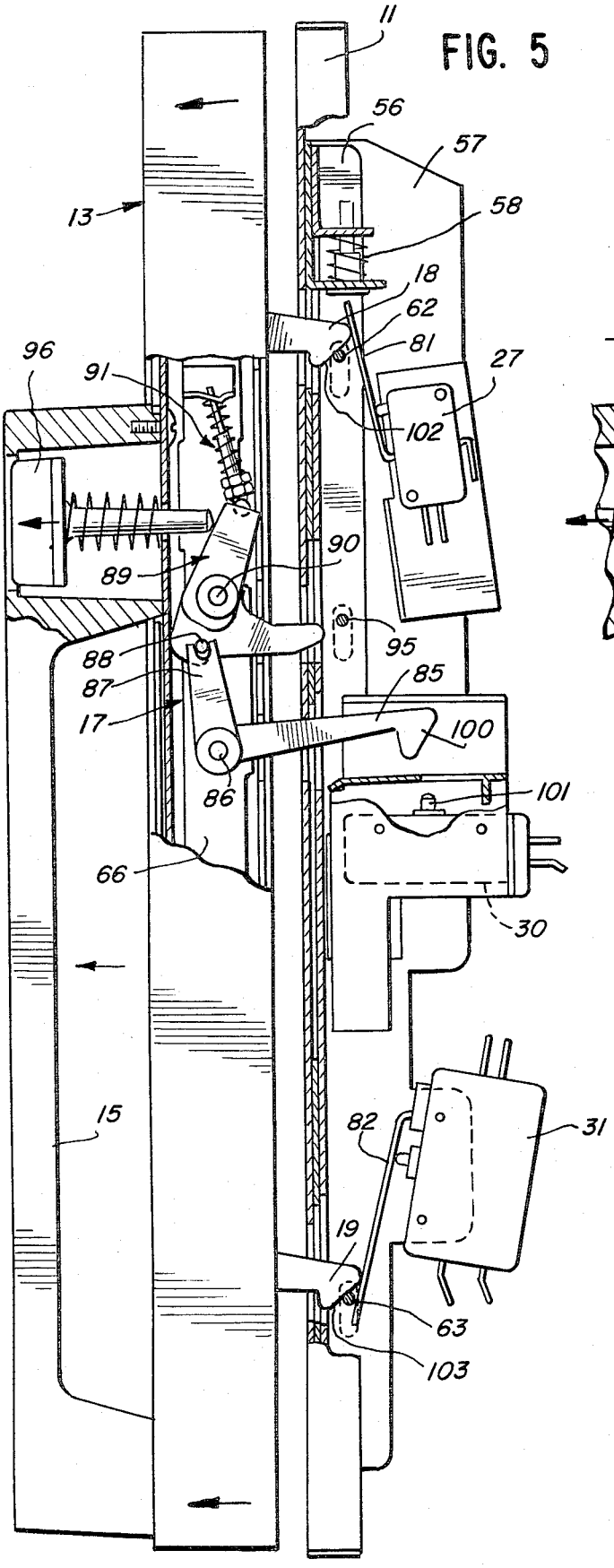
FIG. 5 is a view generally similar to that of FIG. 4 but with the interlock elements arranged in the unlatched disposition and with the closure moved outwardly from the closed position.

However, as illustrated in FIG. 5, when the closure door is moved away from the closed position by application of an outward force to the closure handle 15 whenever the latch means is in an unlatched condition, latch 18 and latch 19 move outwardly with the closure door so as to release actuator 81 of switch 27 and actuator 82 of switch 31 thus allowing switch 31 to open and switch 27 to close, conditioning switches 31 and 27 to an "off" condition of the generating means 21, as illustrated in FIG. 2. As further shown in FIG. 5, toggle 91 maintains the actuator mechanism 17 in the thrown disposition notwithstanding the movement of the pushbutton 96 outwardly from engagement with arm 89 as upon release of the pushbutton by the user of the oven.

As seen in FIG. 5, clockwise rotation of arm 89 on pivot 90 causes a counterclockwise rotation of crank arm 87 through its connection with pin 88, thereby effecting the desired counterclockwise rotation of arm 85 and movement of actuator portion 100 thereof from engagement with the switch actuator 101. As shown in FIG. 5, the toggle 91 maintains the arm 85 in this disposition.

Thus, when the closure door is in the open position of FIG. 1, the control circuit is arranged to effectively prevent operation of the microwave energy generating means 21 as a result of the open condition of the primary door interlock switch 30 and the secondary door interlock switch 31. The control circuit provides an improved functioning in this regard as the de-energization of the generator 21 is effected immediately upon unlatching of the door mechanism by the switch 30 and a supplemental de-energization arrangement by the switch 31 as a result of movement of the door from the closed position.

Figure 6:
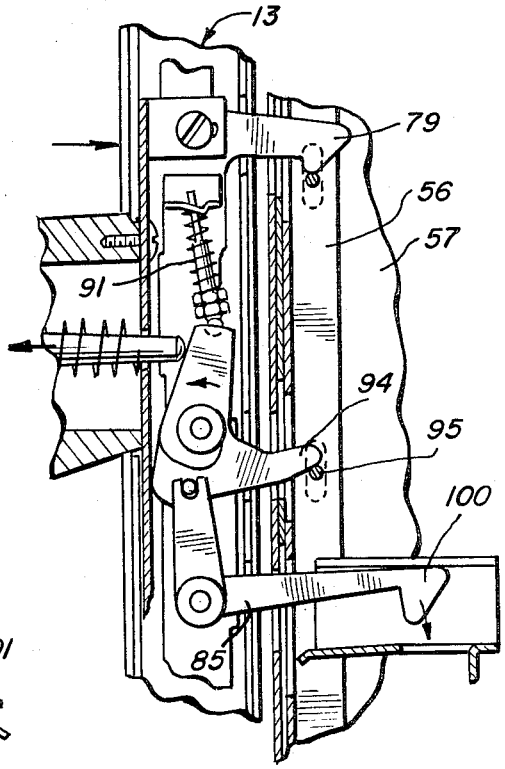
FIG. 6 is a fragmentary elevation illustrating the arrangement of the interlock means in returning the closure back to the closed position.

As best seen in FIG. 5, latches 18 and 19 define camming surfaces 102 and 103 respectively, which abut the pins 62 and 63 respectively, fixedly carried on the slider member 56. Thus, when the door is being returned to the closed disposition, camming surfaces 101 and 102 engage the catches 62 and 63 to urge the slider member 56 downwardly against the biasing action of spring 58, thereby further moving downwardly the follower 95 so as to permit arm 94 to bear against the top of follower 95 and thereby permit the reaction of follower 95 against arm 94 to pivot the arm in a counterclockwise direction, as shown by the arrow in FIG. 6, to throw the toggle 91 outwardly and thereby reposition the latching mechanism in the latching disposition illustrated in FIG. 3. In moving to the latching position, arm 85 is pivoted clockwise so as to bring portion 100 thereof against the actuator 101 of switch 30. At the same time, latch portions 18 and 19 bear against actuators 81 and 82 of switches 27 and 31 respectively, to permit energization of the generating means 21 as upon closure of start switch 34, as discussed above.

Thus, the present invention comprehends an improved latch mechanism for use in a microwave oven which permits unlatching of the door by suitable manipulation of a release mechanism while permitting the door to be closed and latched simply by swinging it to the closed position. The means carried by the door for effecting the interlocked latched relationship is mounted to a vertical support bar for facilitated installation. In the illustrated embodiment, the latches on the closure door engaging the catches on the cabinet are formed integrally with the support bar. The manipulating mechanism is arranged to operate an actuator for suitably arranging the catches for effecting the desired release or latching conditions. The slide member of the mechanism is provided with a guide roller follower adapted to be engaged by a portion of the manipulatable mechanism to effect the desired rearrangement of the mechanism.

The present invention provides a further improvement over that of the prior structure of assignee as embodied in the Doner U.S. Pat. No. 4,101,750, as discussed above.

The foregoing disclosure of specific embodiments is illustrative of the broad inventive concepts comprehended by the invention.

We claim:

1. In a microwave oven having a cabinet defining an oven cavity provided with an opening, a closure movably mounted to said cabinet for movement between a closed position closing said opening and an open position providing access to said opening, electrically operable microwave energy generating means for supplying microwave energy to said cavity, and an electrical circuit including switch means for controlling delivery of electric power from an external source to said generating means, improved means for selectively securing said closure in a closed position wherein the closure sealingly closes said opening automatically as an incident of the closure being moved to said closed position comprising:

a slider member movably mounted to said cabinet for movement between released and latching positions;

catch means movable with said slider member;

means for biasing said slider member toward the latching position at all times;

latch means carried by said closure and engageable with said catch means for automatically latching said closure in the closed position as an incident of said closure being moved to said closed position with said slider member being disposed in said latching position;

actuator means for operating said switch means to permit operation of said generating means only when said closure is latched in said closed position; and manually operable means for arranging said actuator means to cause said switch means to prevent operation of the generating means and concurrently move said slider member to said released position for unlatching said closure while in said closed position and thereby permitting said unlatched closure to be moved selectively from said closed position to said open position.

2. The microwave oven structure of claim 1 wherein said switch means include first and second switches for controlling provision of electrical power to said generating means, and said latch means includes means for causing said second switch to close for permitting operation of the generating means only when the closure is in said closed position.

3. The microwave oven structure of claim 1 wherein said manually operable means includes a pushbutton mechanism carried by said closure.

4. The microwave oven structure of claim 1 wherein said manually operable means includes a pushbutton mechanism carried by said closure and means for biasing said pushbutton mechanism to arrange said actuator means to cause said switch means to permit energization of said generating means only when the closure is latched in the closed position.

5. In a microwave oven having a cabinet defining an oven cavity provided with an opening, a closure mounted to said cabinet for movement between a closed position closing said opening and an open position providing access to said opening, electrically operable microwave energy generating means for supplying microwave energy to said cavity, and an electrical circuit including a plurality of switches carried by said cabinet for controlling delivery of electric power from an external source to said generating means, improved means for selectively securing said closure in a closed position wherein the closure sealingly closes said opening comprising:

a guide on said cabinet;

a slider member movably carried by said guide for movement between released and latching positions;

catch means carried by said slider member;

means for biasing said slider member toward the latching position at all times;

latch means carried by said closure and engageable with said catch means to latch the closure in the closed position as an incident of said closure being moved to said closed position with said slider member being disposed in said latching position;

actuator means carried by said closure for operating one of said switches to permit operation of said generating means only when said closure is latched in said closed position;

manually operable means carried by said closure for arranging said actuator means to cause said one switch to prevent operation of the generating means and concurrently move said slider member to said released position against the action of said biasing means for unlatching said latch means from said catch means with said closure disposed in said closed position, thereby permitting the unlatched closure to be moved selectively from said closed position to said open position; and means carried by said latch means for causing a second of said switches to permit operation of said generating means only when the closure is in the closed position.

6. The microwave oven structure of claim 5 wherein said catch means comprises a pin fixedly carried by said slider member.

7. The microwave oven structure of claim 5 wherein said actuator means comprises a first portion engageable with said slider member to disengage said catch means from said latch means in the closed position of the closure, and a second portion defining an actuator for actuating said one switch.

8. The microwave oven structure of claim 5 wherein said means carried by the latch means comprises an integral distal end portion of the latch means.

9. The microwave oven structure of claim 5 wherein said latch means further defines cam means for urging the catch means to move the slider member toward said released position.

10. The microwave oven structure of claim 5 wherein said actuator means and manually operable means comprise a first pivot member pivotally carried by the closure and releasably engaging said slider member, a second pivot member pivotally carried by the closure releasably engaging said one switch, and manipulatable means carried by the closure for pivoting the pivot members.

11. The microwave oven structure of claim 5 wherein said actuator means and manually operable means comprise a first pivot member pivotally carried by the closure and releasably engaging said slider member, a second pivot member pivotally carried by the closure releasably engaging said one switch, means for pivoting said second pivot member as a result of pivoting of the first pivot member, and manipulatable means carried by the closure for pivoting the pivot members.

12. In a microwave oven having a cabinet defining a cavity having an access opening, a closure for selectively sealingly closing said opening having a handle thereon, and microwave generating means for producing microwave energy within said cavity, means for releasably securing said closure in the closed position and concurrently electrically connecting said generating means to a source of electrical potential comprising:

a vertical support extending along an edge of said closure, said support having horizontal extending arms fixed thereon, each of said arms having vertically downwardly extending fingers at a distal end;

a pair of interconnected arms pivoted from said support in vertically spaced relationship to each other, said pivoted arms extending horizontally from said support, a lower of said pivoted arms having a downwardly extending finger thereon:

a vertically disposed guide channel within said cabinet having an upwardly biased slide channel positioned for vertical reciprocating movement therein, said guide channel and said slide channel having aligned apertures for receiving said arms when said closure is in said closed position, said slide channel having horizontal pins mating in locking relationship with said fingers on said fixed arms when said closure is in said sealing relationship, said guide channel having a secondary switch and a monitor switch mounted thereon engaged by said fixed arms and operated to an "on" position of said generating means when said closure is moved to said sealing relationship;

a guide roller on said slide channel operable when said pins move to lock the fixed arms to bear against and pivot an upper of the pivoted arms, said pivot movement operating through said interconnection to rotate said lower pivoted arm to bring said finger on said lower pivoted arm into moving contact with a primary interlock switch, said moving contact closing said switch; and pushbutton means connected to said closure handle for freeing said pins from said fixed arm fingers and for removing said lower pivoted arm contact from said primary interlock switch, said button means being inwardly movable to bear against a vertical portion of the upper pivoted arm to pivot said upper pivoted arm against said roller to move said slide channel downwardly releasing said pins from said fixed arm fingers, whereby an outward force applied to said closure handle after pushing said pushbutton means will allow movement of said door out from said closed position and concurrently cause said monitor and secondary switches to be in an "off" condition to de-energize said generating means.

13. The microwave oven structure of claim 12 wherein said vertical support comprises a bar carried by the closure.

14. The microwave oven structure of claim 12 wherein said closure comprises a door pivotally mounted to said cabinet for horizontal swinging movement.

15. The microwave oven structure of claim 12 wherein said fixed arms are formed integrally with said support.

16. The microwave oven structure of claim 12 wherein said pivoted arms are interconnected by cooperating pin and link means.

17. The microwave oven structure of claim 12 wherein toggle means are provided for selectively retaining said pivoted arms in oppositely thrown dispositions.

18. The microwave oven structure of claim 12 wherein biasing means are provided for biasing said pushbutton means to an outward, released disposition.

* * * * *